US008272178B2

(12) United States Patent
Pardue et al.

(10) Patent No.: US 8,272,178 B2
(45) Date of Patent: Sep. 25, 2012

(54) PRESS-FIT STORM WINDOW

(75) Inventors: Samuel Pardue, Portland, OR (US); Mark Pratt, Portland, OR (US)

(73) Assignee: R Value, LLC, Portland, OR (US)

( * ) Notice: Subject to any disclaimer, the term of this patent is extended or adjusted under 35 U.S.C. 154(b) by 0 days.

(21) Appl. No.: 12/573,174

(22) Filed: Oct. 5, 2009

(65) Prior Publication Data

US 2011/0078963 A1 Apr. 7, 2011

(51) Int. Cl.
*E06B 3/30* (2006.01)
*E06B 7/16* (2006.01)

(52) U.S. Cl. ..... 52/202; 52/203; 52/204.597; 52/716.8; 49/62; 49/498.1

(58) Field of Classification Search ..... 52/202, 52/203, 716.8, 645, 921, 204.597; 49/62, 49/498.1; 277/644, 645, 921
See application file for complete search history.

(56) References Cited

U.S. PATENT DOCUMENTS

| | | | | |
|---|---|---|---|---|
| 1,928,992 | A | 10/1933 | Clark et al. | |
| 2,612,947 | A * | 10/1952 | Jenks | 160/40 |
| 2,691,193 | A * | 10/1954 | Wissinger | 52/204.597 |
| 2,700,196 | A * | 1/1955 | Panhard | 52/204.597 |
| 2,825,941 | A * | 3/1958 | Lux et al. | 52/2.12 |
| 2,837,782 | A * | 6/1958 | White | 52/204.597 |
| 3,110,065 | A | 11/1963 | Dennis | |
| 3,159,884 | A * | 12/1964 | Hankey | 52/2.12 |
| 3,251,399 | A | 5/1966 | Grossman | |
| 3,363,390 | A * | 1/1968 | Crane et al. | 52/716.8 |
| 3,438,150 | A | 4/1969 | Heim | |
| 3,911,630 | A | 10/1975 | Nally | |
| 3,952,455 | A | 4/1976 | McAlarney | |
| 4,040,210 | A | 8/1977 | Land | |
| D247,047 | S | 1/1978 | Damiana | |
| 4,098,035 | A | 7/1978 | Bessler | |
| 4,255,907 | A | 3/1981 | Lightell | |
| 4,355,448 | A * | 10/1982 | Ezaki | 29/413 |
| 4,407,099 | A * | 10/1983 | McLaughlin | 52/202 |
| 4,424,976 | A * | 1/1984 | Hayashi | 277/642 |

(Continued)

FOREIGN PATENT DOCUMENTS

DE 88 04 447 12/1988

(Continued)

OTHER PUBLICATIONS

International Search Report and Written Opinion for PCT/US2010/051503, mailed Dec. 14, 2010, 9 pages European Patent Office, Rijswijk, Netherlands.

*Primary Examiner* — Robert Canfield
(74) *Attorney, Agent, or Firm* — Marger Johnson & McCollom PC

(57) ABSTRACT

Described are a new type of storm windows, along with an easy way (and less expensive) of installing the press-fit storm window, on existing frames or windows, without the hassle and expense of replacing the whole window (to save time, cost, and inconvenience), to increase R-value (insulation efficiency) for the windows (i.e. reduce energy waste). This relates to the construction and installation and use of easily installed low cost interior or exterior storm windows, which are attractive and effective in reducing heat and noise transmission. Different approaches and variations to implement this are shown here.

11 Claims, 6 Drawing Sheets

U.S. PATENT DOCUMENTS 4,430,374 A * 2/1984 Ezaki ..... 428/135
4,453,855 A * 6/1984 Richter et al. ..... 403/295
4,477,507 A * 10/1984 Kunert ..... 428/188
4,486,990 A * 12/1984 Bauch ..... 52/202
4,592,180 A 6/1986 Gerritsen
4,599,825 A * 7/1986 Sixsmith ..... 49/466
4,668,556 A * 5/1987 Hermann et al. ..... 428/122
4,682,443 A 7/1987 Demo
4,703,598 A * 11/1987 Wilson et al. ..... 52/238.1
4,706,729 A 11/1987 Sixsmith
4,946,174 A * 8/1990 Usui ..... 277/645
5,011,163 A * 4/1991 Hermann et al. ..... 277/653
5,131,194 A * 7/1992 Anderson ..... 52/144
5,209,498 A 5/1993 Colin
5,305,552 A 4/1994 Guillon
5,312,672 A 5/1994 Dittmeier et al.
5,361,542 A 11/1994 Dettloff
5,390,974 A 2/1995 Theodorakakos
5,737,885 A * 4/1998 Stoyke ..... 52/202
5,809,707 A * 9/1998 Bargados et al. ..... 52/204.62
5,819,472 A 10/1998 Frost
5,937,595 A 8/1999 Miller
6,052,957 A * 4/2000 Minnich ..... 52/202
6,223,497 B1 * 5/2001 Ohtake et al. ..... 52/800.14
6,460,300 B2 * 10/2002 Mikkaichi et al. ..... 52/204.597
6,684,574 B2 2/2004 Hayashi
6,742,565 B2 6/2004 Badley
6,865,850 B1 3/2005 Campbell
6,877,286 B2 * 4/2005 Johnson ..... 52/202
6,922,945 B2 8/2005 Dron
6,945,540 B2 * 9/2005 Bormann et al. ..... 277/644
7,228,662 B1 * 6/2007 John ..... 52/204.1
7,481,030 B2 1/2009 Grunst
7,490,445 B2 2/2009 Steffek et al.
7,546,793 B2 6/2009 LaSusa
2007/0113482 A1 5/2007 Dumke et al.
2009/0025317 A1 1/2009 Wirz et al.

FOREIGN PATENT DOCUMENTS

FR 2 759 112 8/1998

* cited by examiner

PRESS-FIT STORM WINDOW

BACKGROUND

A continuing goal is to have more energy saving and a lower energy bill amount for buildings (both for residential and commercial), which has an added benefit of reducing the emissions that cause global warming. One way is to reduce the amount of energy escaping/exchanging through windows. A method of measuring the efficiency of insulation for heat transfer is R-value. An R-value indicates the insulation's resistance to heat flow. (A higher R-value would indicate a greater insulating effectiveness.) The R-value generally depends on the type of insulation (e.g. material, thickness, and density). To find the R-value of a multilayered system, one would add the R-values of the individual layers.

In the current invention, press-fit storm windows are installed on existing frames or windows, without the hassle and expense of replacing the whole window (to save time, cost, and inconvenience), to increase R-value for the windows (i.e. reduce energy waste).

In the prior art, U.S. Pat. No. 7,481,030 teaches methods and structures for sealing air gaps in a building. It teaches a seal structure for sealing an air gap between a framing member and a wallboard, the seal structure being formed on a framing member from a curable, flowing material and comprising: a body having first and second opposing surfaces, the first surface of the body being bonded to the framing member; and at least one flexible seal member integral with and extending generally transversely with respect to the second surface of the body, the seal member; wherein the body and the at least one seal member are formed from air curable silicone caulk on said framing member defines a seal between the framing member and the wallboard, when the wallboard engages a distal end of the seal member.

In the U.S. Pat. No. 7,546,793 (dated Jun. 16, 2009) (titled "Window component notching system and method"), LaSusa teaches: A system and method for producing window components using polymer based, metallurgy based, extruded, injection molded, or wooden lineal material. The lineal material is notched at intervals calculated to include a stretch treatment and folded to form window components, such as window sashes, frames, and the like. Internal reinforcing members may be welded within the joints formed by folding at the notches. The notching system and method provide low cost, highly reliable, low defect production of multi-sided window components from a continuous piece of lineal material.

U.S. Pat. No. 7,490,445, Steffek et al., dated Feb. 17, 2009, titled "Integrated window sash", teaches: An integrated window sash, which includes a sash frame having a first sheet supporting surface, a second sheet supporting surface spaced from the first sheet supporting surface, and a base between the first and second sheet supporting surfaces, the base defining an opening; a first sheet having a first major surface and an opposite second major surface with marginal edge portions of the first surface of the first sheet secured to the first sheet supporting surface, the first sheet sized to pass through the opening toward the first sheet supporting surface; a second sheet having a first major surface and an opposite second major surface with marginal edge portions of the first surface of the second sheet secured to the second sheet supporting surface, the second sheet sized to be larger than the opening, wherein the first major surface of the second sheet faces the second major surface of the first sheet and is spaced therefrom to provide a compartment between the sheets; and a retainer mounted on the base between the sheets and having a first end portion engaging surface portions of the second surface of the first sheet and an opposite second end portion secured to the base.

Embodiments of the invention address these and other problems in the prior art.

SUMMARY

Embodiments of the present invention relate generally to easily and inexpensively adding a primary or secondary panel to an existing framed opening in a building. New demands emerging on the energy or audio characteristics of buildings are requiring increasingly expensive and difficult-to-install devices (and related methods). This particularly applies to historic buildings, but can apply to recent structures built before the awareness of the importance of energy and audio efficiency. At present, there is no device or method that is well accepted as adequately low in cost, outstanding in appearance and performance, and simultaneously easy to install. Therefore, an advantage of the preferred embodiments of the present invention is to provide energy and/or sound isolating panels suitable for use in any building.

In embodiments of the current invention, we introduced an easy way (and less expensive) of installing the press-fit storm window, on existing frames or windows, without the hassle and expense of replacing the whole window (to save time, cost, and inconvenience), to increase R-value for the windows (i.e. reduce energy waste).

DETAILED DESCRIPTION OF THE PREFERRED EMBODIMENTS

In one embodiment of the inventive press-fit storm window, a transparent panel of acrylic glass, such as PLEXIGLAS, glass, or other clear rigid material is held in place by the spring action created by a continuous (or partial, conceivably) round gasket (or other spring-like gasket), that creates outward pressure around the entire exterior edge of the clear panel (or the top, left, and right sides).

The panel is held securely in place through a combination of this outward pressure and friction. The press-fit storm window can be installed on the interior or exterior of a structure. The windows are not designed to replace existing windows, but rather to supplement them by creating a tight seal between the interior space or exterior space and the existing window.

The benefits of the device are much greater insulation (R value, technically) for an existing window (energy-efficient or lower energy bills), as well as a significant reduction in noise passing through the window or portal into which the press-fit storm window is placed. The device will be dramatically less expensive than upgrading an existing single pane window to a more efficient dual pane window, without any real cutting the walls, which entails construction of the outside and inside, which means inconvenience and expense (reluctance to upgrade), for the home owners.

Another benefit is that these press-fit windows will preserve the architectural integrity of the existing windows, in older homes. Customers will be able to install the windows in a matter of minutes with no screws, nails, or adhesives, which points to a third major benefit of the windows: They provide dramatic environmental and efficiency improvements, while preserving the architectural integrity of homes.

Figure 1:
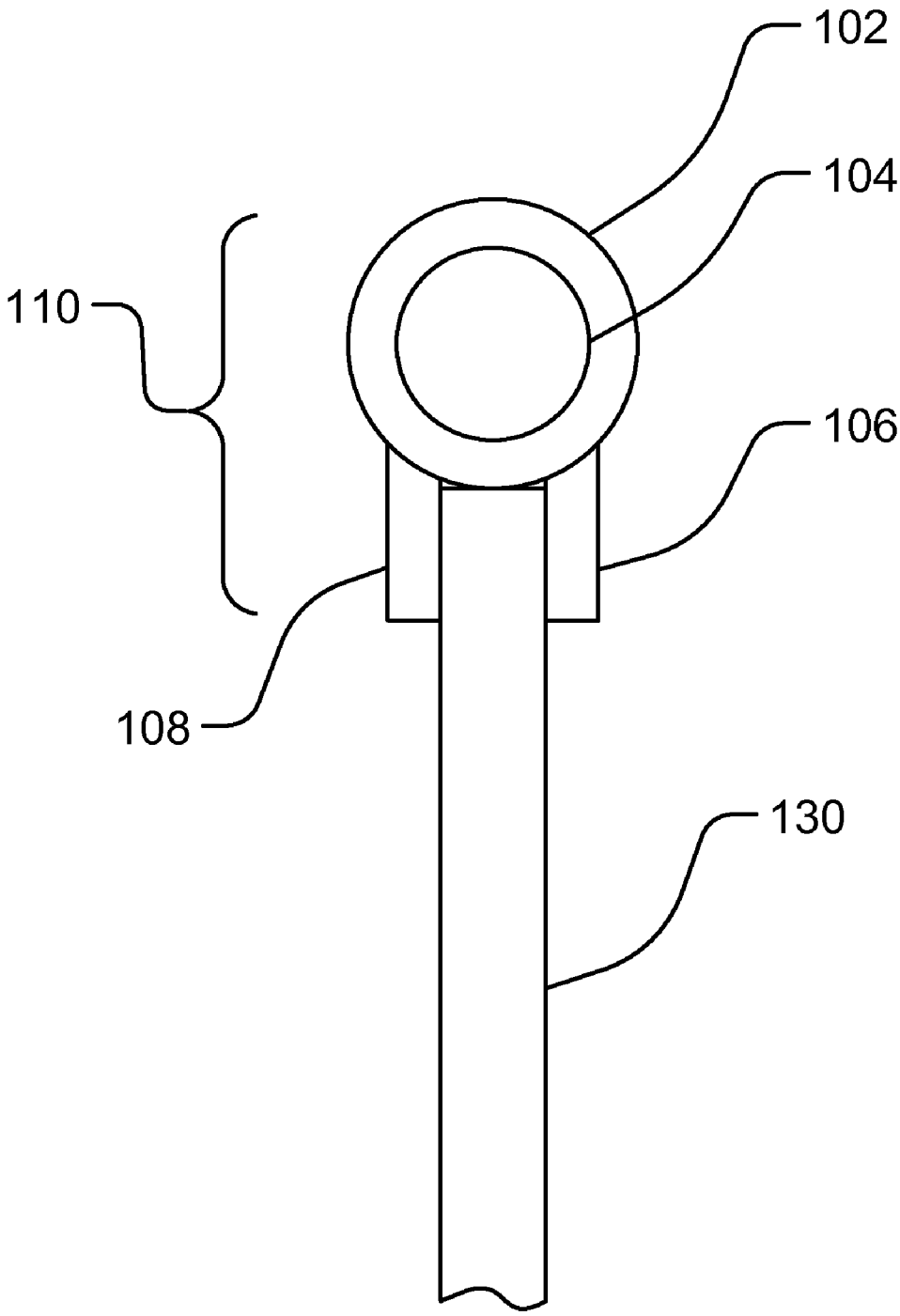
FIG. 1 shows the extrusion to put around edge of a press fit storm window to allow a pressure fit into window frames (profile view).

FIG. 1 shows the extrusion to put around edge of a press fit (440) storm window to allow a pressure fit into window frames (profile view). FIG. 1 displays round or oval shaped tube formed from a springy material with 'hollow' interior (102 and 104, or 402 and 410, or 502 and 510). 'Hollow' space could be air or foam. 'Channel groove' connects bulb to clear panel (106, 108, and 110). It also shows 'spring' plastic extrusion, which is UVA resistant. (It will be exposed to sunlight, heat, and cold.) As an example, ⅛" clear acrylic glass panel (PLEXIGLAS) is used, but other material can be used, as well (130 or 530).

Figure 2:
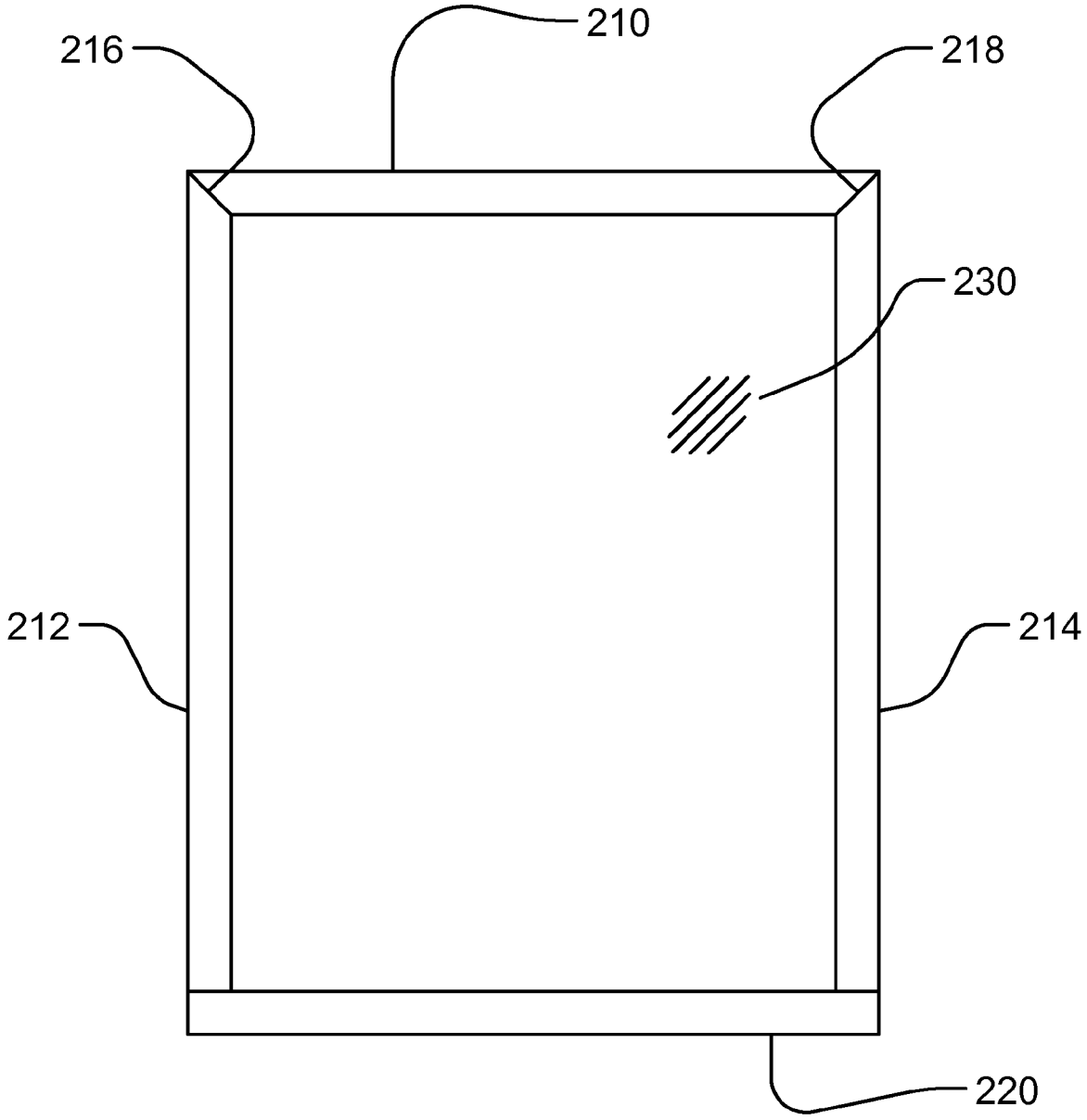
FIG. 2 shows the extrusion to put around edge of a Press Fit Storm Window™ to allow a pressure fit into window frames (Front or rear view).

FIG. 2 shows the extrusion to put around edge of a press-fit storm window to allow a pressure fit into window (560) frames (540 and 542) (Front or rear view) (210, 212, 214, and 220). FIG. 2 shows that the spring tube extrusion is fitted around the panel. Corners are cut at 45 degree angle (216 and 218) and sealed with thermal sealer or glue, as an example, but it can be any other form/angle and any adhesive method. It shows ⅛" acrylic glass, front or rear view (230). FIG. 2 shows the bottom extrusion, possibly of a different material, formed into a similar profile. Material could be of a semi-rigid and non compressing tube to prevent 'droop', as an example of embodiments, but not limiting the scope of the invention.

Figure 3:
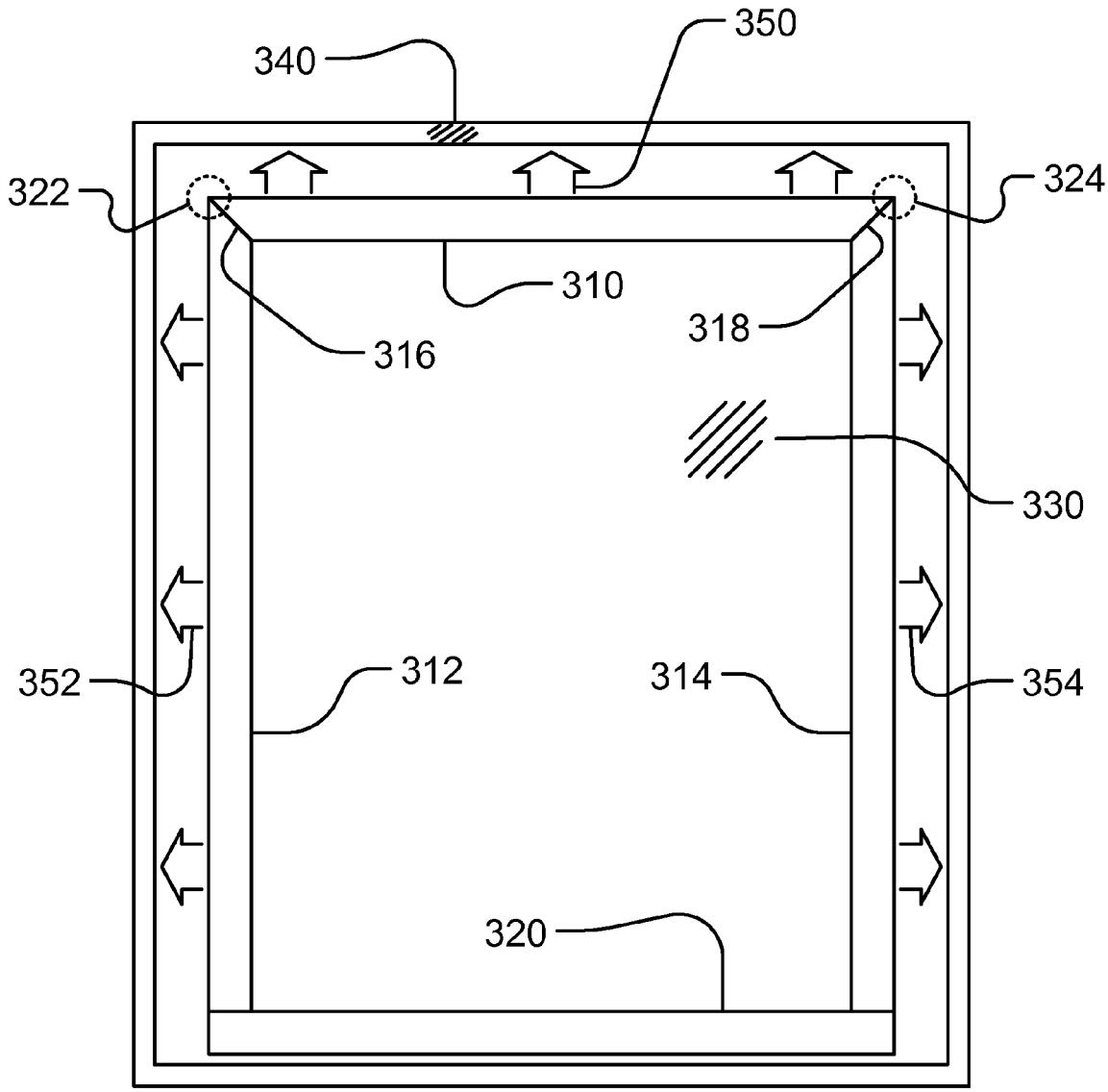
FIG. 3 shows the extrusion to put around edge of a Press Fit Storm Window™ to allow a pressure fit into window frames (Installation view).

FIG. 3 shows the extrusion to put around edge of a press-fit storm window to allow a pressure fit (350, 352, and 354) into window frames (Installation view), at the edges (322 and 324, or 522) and sides (310, or 408, 312, 314, and 320, or 508). FIG. 3 shows the plastic tube is fitted (516) around acrylic glass panel (330 or 430). Corners are cut at 45 degree angle (316 and 318 or 418) and sealed with a thermal sealer. These are just some examples for one embodiment, and can be any other angle and any other sealant or adhesive, commonly known and used for windows. It displays ⅛" acrylic glass, front or rear view. It shows the plastic extrusion, when compressed by after being pressed into the window frame (340), which creates an outward pressure that holds the acrylic glass into place.

Figure 4:
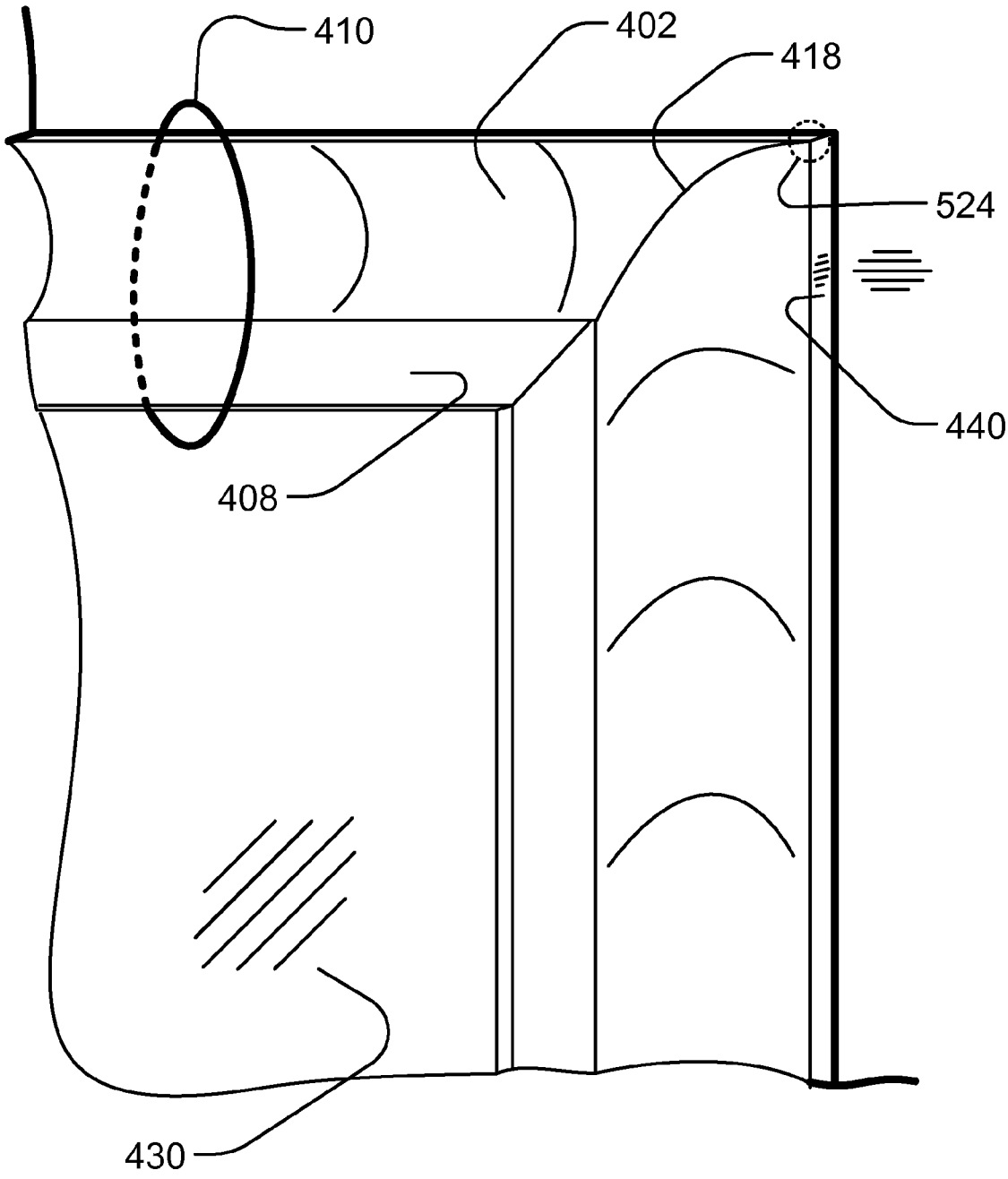
FIG. 4 shows the view of the upper corner, as installed.
Figure 5:
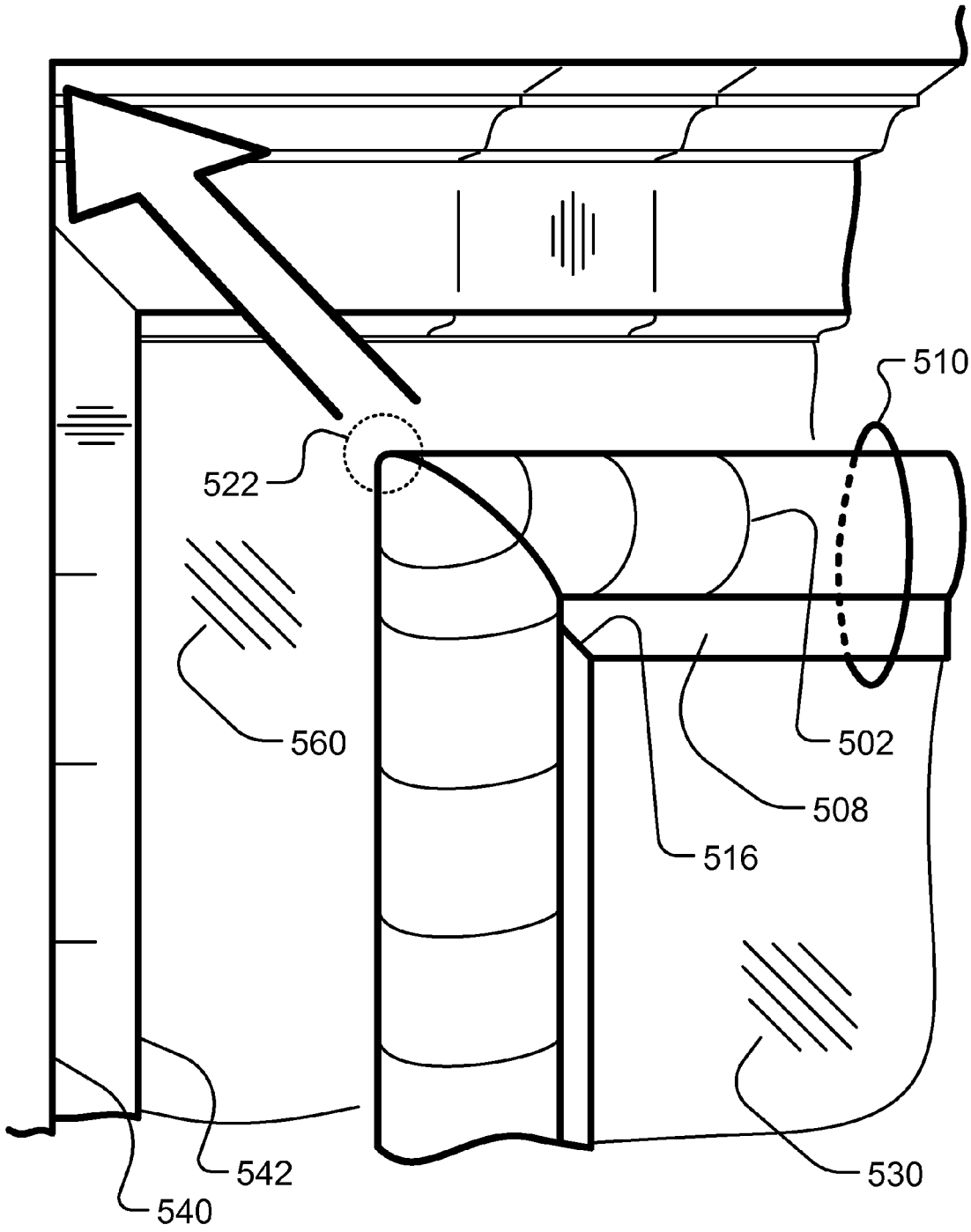
FIG. 5 shows the view of the upper corner, as un-installed or removed.

The other figures display various views and configurations for the setup described above. FIG. 4 shows the view of the upper corner, as installed. FIG. 5 shows the view of the upper corner, as un-installed or removed.

Figure 6A:
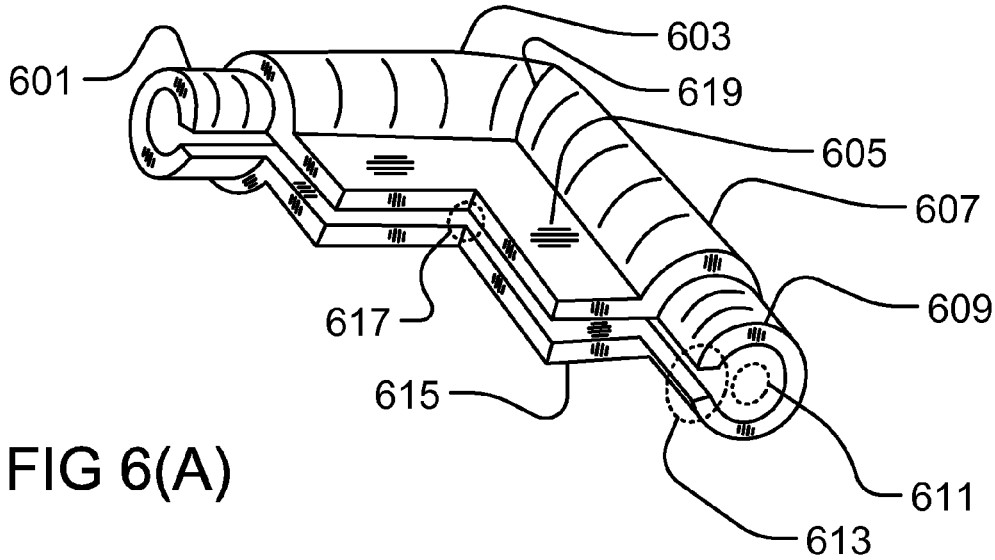
FIGS. 6 (*a*), 6 (*b*), and 6 (*c*) show silicon molded corner piece, in 3 different views/angles.
Figure 6B:
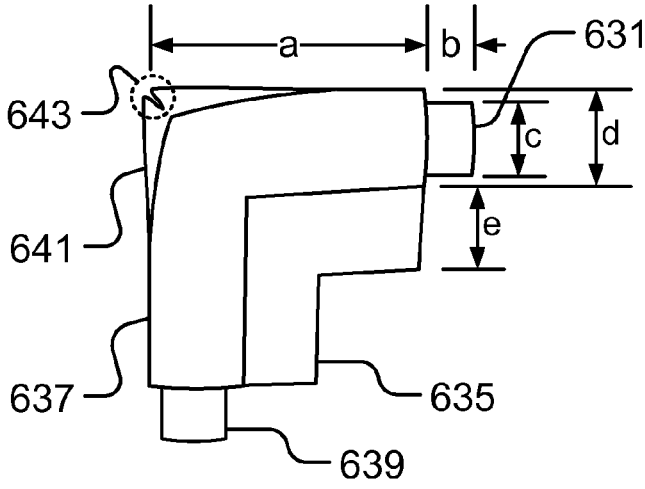
Figure 6C:
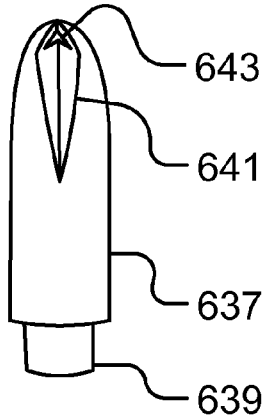

FIGS. 6 (*a*), 6 (*b*), and 6 (*c*) show silicon molded corner piece, in 3 different views/angles, which is another embodiment, with some different features. The shape shown in FIG. 6 makes it easier to fit the window, and seal it better, with better flexibility, for minor adjustments, and accommodating imperfections in the original frame or window. Note the shape at the corner, and also the layered structure (with tube and skin, or shell, plus a narrow fin on the back), as shown in FIG. 6, for better flexibility and coverage. The typical distances are: 1.25" for a, (⅜)" for b and c, (⅝)" for d, and 0.5" for e, as distances shown in FIG. 6(*b*). However, these values can range from 10 percent of these typical values to 500 percent of these typical values, and this invention would still work.

In an example, item 603 or 607 or 637 in FIG. 6 represents outer layer or shell; 601 or 609 or 639 or 631 is the inner layer, with inner cross section 611, and a gap 613; 619 is the angled cut to attach the pieces 603 and 607 together; 615 and 605 or 635 are parallel plates, with a gap 617 between them; 643 is a notch for better coverage and flexibility; and 641 is the fin at the corner of 637, for better coverage/adhesion/insulation and flexibility; variously shown at different angles, in three figures, FIGS. 6 (*a*), 6 (*b*), and 6 (*c*).

In one of the embodiments, a rubber bulb is added around all edges of a rigid plastic sheet cut to fit inside a window frame. It was intended that metal clips be used to ensure that the panel would stay in place. The assembled panel was first pressed tightly inside the frame. To their surprise, when attempting to remove the panel from the frame, it was found to be necessary to use a prying device. This indicated that the use of the metal clips would unexpectedly not be required, thereby greatly simplifying installation. Thus, this embodiment is very simple, practical, and yet, still, strong.

However, other methods can be combined here, as well: For example, in another embodiment, the panel can also be attached with glues, mechanical clamps, screws, or spring-like o-rings, or combinations of the above. The pressure can be exerted on all sides, one or more sides, locally at the corners, at a selected points only, or by suction (due to pressure difference between the two sides). For example, by a slight variation of the pressure on both sides, the difference on the pressure can partially or fully hold the panel in place.

In another embodiment, the panel can be in place using hangers, belts, chains, ribbons, frames, railings, or gap in frame of the window. In another embodiment, the panel can be hung through a metal or plastic rebar perpendicular to the surface of the panel.

In another embodiment, the panel can be held using its own weight or gravity, partially or fully supported, by using the slight inclined surface, with respect to the ground and a plane perpendicular to the ground. That is, we held the panel not exactly perpendicular to the ground or 90 degrees, but slightly off, say e.g. at the 85 degree angle, with respect to the ground (instead of 90 degrees). It can vary in the range of 80 to 89 degrees, for example.

In another embodiment, the panel can be curved, rather than flat, to stand on it own, based on its center of gravity. This way, the panel can stand on its own by its weight, fully or partially, as long as the center of gravity for the panel is within the boundary of the shadow of the window's frame, to have a stable system, holding up on its own. Of course, we can combine the embodiments above, to make the panel better attached to the window or frame, in the case of snow, fast wind, or storm.

Additional embodiments are, in combination or not-in-combination to above:

i. Use trim with multiple slots or openings to accept the panels. This would allow multi-pane windows.

ii. Use separate corner pieces of trim and bulb, to eliminate bevel cuts and improve appearance.

iii. Use stiffeners before installing trim.

The material used for frames can be plastic, metal, elastic, man-made, natural, or a combination of the above. The shape of windows can be square, rectangular, circle, ellipse, polygon, curved, irregular, symmetric, or not-symmetric, as an example.

Here are more variations and examples:

1. Panel(s) (fills framed opening in building):

a. Materials:

i. Plastic ii. Glass iii. Wood
iv. Metal
v. Other
b. Purposes:
i. Light transmission
ii. Thermal Insulation
iii. Sound isolation
iv. View
v. Privacy
vi. Security
vii. Bulletproofing
c. Light Transmission:
i. Clear, Transparent
ii. Translucent
iii. Opaque
iv. Reflective
v. Colorless
vi. Colored
d. Shape:
i. Rectangular
ii. Square
iii. Polygon of any description
iv. Round
v. Oval
vi. Elliptical
vii. Irregular
viii. Angled to vertical or Curved
ix. Any other
2. Trim (fastens over and frames edge of panel):
a. Material:
i. PVC
ii. EPDM
iii. Silicone
iv. Plastic
v. Rubber
vi. Metal
vii. Other
b. Shape:
i. "C"
iv. "L"
v. Other
3. Internal Clip (internal to and stiffens trim):
a. Material:
i. Aluminum
ii. Steel
iii. Plastic
iv. Rubber
v. Other
vi. None
b. Shape:
i. "C"
ii. "U"
iii. "V"
iv. "L"
v. Other
vi. None
4. Bulb (fastened to or same extrusion as trim):
a. Material:
i. PVC
ii. EPDM
iii. Silicone
iv. Other
b. Shape:
i. "C"
ii. "U"
iii. "V"
iv. "L"
v. Circular
vi. Spiral
vii. Oval
viii. Elliptical
xi. Square
x. Triangular
xi. Other
xii. Square
5. Corner Pieces (eliminates necessity of beveling trim/bulb):
a. Material:
i. Plastic
ii. Rubber
iii. Metal
vi. Identical to bulb
v. Identical to trim
vi. Combined bulb material and trim and clip material
vii. Other
b. Shape (cross-section)
i. Identical with bulb only
ii. Identical with trim only
iii. Identical with combined trim and bulb
vi. Larger than trim, bulb, or combination
v. Smaller than trim, bulb, or combination
vi. Exemplifying aesthetic of building
vii. Other
6. Stiffeners (applied at panel edges to improve overall panel stiffness)
a. Material:
i. Plastic
ii. Rubber
iii. Metal
vi. Other
v. None
b. Shape:
i. "C"
ii. "U"
vi. "L"
v. Open Circular
vi. Open Spiral
vii. Open Triangular
viii. Open Square
ix. Other Any variations of the teachings above are also meant to be covered and protected by this current application.

The invention claimed is:

1. A storm window assembly for placement as a second window in a window frame of a building that also carries a primary window, the storm window assembly comprising:

a transparent panel; and one or more pliable gaskets made from a single material, at least one of the gaskets including a flexible bulb portion that is substantially circular and annular in cross section, and the flexible bulb portion structured to deform when pressure is applied, the one or more pliable gaskets also including a groove portion having a groove defined between a first leg extension and a second leg extension, the first and second leg extensions extending outward from an outside perimeter surface of the flexible bulb portion, and the groove structured to accept an edge region of the panel between the first and second leg extensions;

wherein the one or more pliable gaskets are structured to be inserted into and have direct contact with the window frame, the one or more pliable gaskets additionally structured to deform to frictionally hold the system in the window frame of the building when the system is compress-fit into the window frame adjacent to the primary window.

2. The system as recited in claim 1, wherein the panel is made of glass.

3. The system as recited in claim 1, wherein the panel is made of acrylic glass.

4. The system as recited in claim 1, wherein the one or more pliable gaskets cover the entire perimeter of the panel.

5. The system as recited in claim 1, wherein a portion of the perimeter of the panel is not covered by the one or more pliable gaskets.

6. The system as recited in claim 1, wherein the storm window system is installed as an interior storm window.

7. The system as recited in claim 1, wherein the storm window system is installed as an exterior storm widow.

8. The system as recited in claim 1, wherein the transparent panel insulates against heat transfer.

9. The system as recited in claim 1, wherein the transparent panel insulates against sound.

10. The system as recited in claim 1, wherein the one or more pliable gaskets are formed of a material that does not substantially compress under pressure.

11. The system as recited in claim 10, wherein the shape of at least one of the flexible bulb portions of the one or more pliable gaskets readily deforms under pressure.

* * * * *